US006076563A

United States Patent [19]

Wahhoud et al.

[11] Patent Number: 6,076,563

[45] Date of Patent: Jun. 20, 2000

[54] WEFT STRETCHING AND DETECTING APPARATUS FOR A JET WEAVING LOOM

[75] Inventors: Adnan Wahhoud; Hans-Dieter Scorl, both of Lindau, Germany

[73] Assignee: Lindauer Dornier Gesellschaft mbH, Lindau, Germany

[21] Appl. No.: 09/264,749

[22] Filed: Mar. 9, 1999

Related U.S. Application Data

[63] Continuation-in-part of application No. 09/232,486, Jan. 15, 1999.

[30] Foreign Application Priority Data

Mar. 9, 1998 [DE] Germany ..... 198 10 129

[51] Int. Cl.[7] ..... D03D 47/28; D03D 51/34

[52] U.S. Cl. ..... 139/194; 139/370.2

[58] Field of Search ..... 139/194, 370.2

[56] References Cited

U.S. PATENT DOCUMENTS

| | | | |
|---|---|---|---|
| 4,465,110 | 8/1984 | Dekker | 139/194 |
| 5,606,998 | 3/1997 | Wahhoud et al. . | |
| 5,735,316 | 4/1998 | Hehle . | |

FOREIGN PATENT DOCUMENTS

| | | |
|---|---|---|
| 0645485 | 3/1995 | European Pat. Off. . |
| 0716171A2 | 6/1996 | European Pat. Off. . |
| 3810335 | 10/1989 | Germany . |
| 3200637 | 8/1992 | Germany . |

*Primary Examiner*—Andy Falik
*Attorney, Agent, or Firm*—W. F. Fasse; W. G. Fasse

[57] ABSTRACT

A weft stretching and detecting device has a first section (1A) for stretching a weft thread and a second section (1B) for monitoring the arrival of a leading weft end (11A) either through a weft guide path (4, 7, 7B) which is aligned with a weft insertion channel (2A), or through a weft stretching guide channel (6, 9, 8) which is laterally displaced relative to the weft insertion direction defined by the weft insertion channel. The weft monitoring second section (1B) is mounted in a sley extension (3A) for a sliding movement axially back and forth along the sley extension (3A), whereby a spacing between the first section (1A) and the second section (1B) is adjustable. A single weft stop motion device (10) is mounted in the weft monitoring second section (1B) for monitoring the weft guide path and the weft guide channel for the arrival of a weft thread leading end through the guide path or through the guide channel.

7 Claims, 2 Drawing Sheets

WEFT STRETCHING AND DETECTING APPARATUS FOR A JET WEAVING LOOM

CROSS-REFERENCE TO RELATED APPLICATION

This application is a Continuation-In-Part application of parent application U.S. Ser. No. 09/232,486, filed Jan. 15, 1999, for: "WEFT STRETCHING AND DETECTING APPARATUS FOR A JET WEAVING LOOM" by Hans-Dieter Scorl and Ralf Koenen. The entire disclosure of the parent application is incorporated herein by reference. Said U.S. Ser. No. 09/232,486 is based on German Serial Number 198 02 254.9, filed in Germany on Jan. 22, 1998.

PRIORITY CLAIM

This application is based on and claims the priority under 35 U.S.C. §119 of German Patent Application 198 10 129.5, filed on Mar. 9, 1998.

FIELD OF THE INVENTION

The invention relates to a weft stretching and detecting apparatus for a jet weaving loom. The apparatus is arranged with its inlet side at the exit of a weft thread insertion channel in a reed carried by a sley of the air jet weaving loom. Preferably, the apparatus is mounted on an extension of the loom sley.

BACKGROUND INFORMATION

U.S. Pat. No. 5,606,998 (Wahhoud et al.), issued on Mar. 4, 1997, corresponding to European Patent Publication EP 0,716,171 A2, discloses a weft detecting and stretching device for a jet weaving loom, wherein the weft insertion channel in the reed can be extended by one or more channel extension members and/or by intermediate inserts and by a telescoping feature, for accommodating various positions of the extension members, whereby the weft stretching and detecting device can accommodate different weft stretching characteristics. One embodiment of the known device has a weft stretching channel with its own and weft stop motion device and an extension channel also with its own weft stop motion device for detecting faulty weft threads. The other embodiment of the known device has only a weft insertion channel extension that is adjustable in its length and has its own weft stop motion device. The output signals of the weft stop motion devices are transmitted to the central loom control to stop the loom in response to a detection of a faulty weft thread. The stretching of the weft thread is accomplished by diverting the leading end of the weft thread out of a guide channel that is aligned with the weft insertion channel in the reed, into the weft stretching channel that is laterally displaced from the guide channel. By diverting the weft into the stretching channel with an air jet blowing the required stretching is accomplished.

The known apparatus is equipped with two weft stop motion devices in one embodiment. Further, an additional air jet nozzle is required if a modified stretching is intended in the guide channel.

German Patent DE 3,200,637 C2 (Dekker) discloses an air jet weaving loom with two waft stop motion devices, one of which is positioned in the weft insertion channel near the exit end of the channel and the other is positioned in a weft diversion channel outside the exit end of the insertion channel. The first mentioned weft stop motion provides a signal when the inserted weft thread is too short. The second weft stop motion provides a signal when the inserted weft thread is too long.

German Patent Publication DE 3,810,335 A1 (Rupp et al.), discloses an air jet loom with a stretching needle for the weft thread. The stretching needle is positioned in a spacing between the warp threads near the end of the weft insertion channel in the air weaving loom reed.

U.S. Pat. No. 5,735,316 (Hehle), discloses a leading end weft stretcher for an air jet weaving loom. A first weft stop motion device is arranged near the selvage forming portion of the reed to monitor the arrival of a leading end of a weft thread. A stretcher is arranged downstream of the exit end of the weft insertion channel. The stretcher is equipped with its own weft stop motion device. However, the stretcher is not adjustable for different stretching characteristics of the weft thread.

European Patent Publication EP 0,645,485 A1 (Granelli et al.) discloses a stretching device for an air jet weaving loom. The device is positioned at the exit end of the insertion channel and the stretching channel has an arc-shape that returns with its exit end into the extension of the weft insertion channel. At least two weft stop motion devices (7) and (13) are needed.

The above described prior art leaves room for improvement, especially with regard to the simplification of the weft stretcher construction and with regard to the reduction of structural components.

OBJECTS OF THE INVENTION

In view of the foregoing it is the aim of the invention to achieve the following objects singly or in combination:

- to provide a weft stretching and detecting apparatus for an air jet weaving loom in which faulty weft threads such as weft threads that are too long or too short or broken are properly detected and can be selectively deflected into a stretching guide channel, whereby the construction shall be simpler while simultaneously assuring a higher functional reliability;
- to construct the stretching device with its weft stop motion in such a way that it is easier to install in a loom and maintenance work shall be facilitated;
- to divide the stretcher into two sections that are independent of each other, but cooperate with each other so that only one weft stop motion is needed in common for a weft stretching channel and for a weft guide path; and
- to make the spacing between the two sections readily adjustable in the weft insertion direction.

SUMMARY OF THE INVENTION

A weft stretching and detecting apparatus for a jet weaving loom with a sley (3) and a reed (2) forming a weft insertion channel (2A), is characterized by the following combination of features. A sley extension (3A) has mounted thereon at least one of two sections 1A and 1B or preferably both sections. A weft stretcher forms a first section (1A) which is mounted next to the reed at the exit end of the weft insertion channel (2A) which defines a weft insertion direction formed in the reed. A weft monitoring second section (1B) is mounted for a sliding movement on the sley extension (3A) and spaced from the weft stretcher or weft stretching first section (1A) in the weft insertion direction. A weft guide path (4, 7, 7B) is formed in axial alignment with the weft insertion direction in and between the first and second sections (1A and 1B). A weft stretching and guide channel (6, 8, 9) extending laterally displaced from said weft guide path is formed in and between the first and second sections (1A, 1B). A single weft stop motion device (10)

positioned in said weft monitoring second section (1B) for monitoring a weft thread passing through the weft guide path or through said weft stretching and guide channel. The single weft stop motion device (10) is position adjustable with a position adjustment of said weft monitoring second section (1B). The guide path is used when weft threads merely temporarily stretch due to the transport force applied by the insertion jets to the weft threads. The stretcher channel is used when it is intended to apply an additional stretching force to the weft threads.

It is an advantage of the invention that a single weft stop motion device is required which additionally is position adjustable in the direction of the weft insertion channel. Another advantage of the invention is seen in that a weft guide path portion between the weft stretching first section and the weft monitoring second section is an open air weft path portion which makes the entire structure lighter and more easily accessible. It has been found, surprisingly, that the travel of the leading end of a weft thread through open air does not divert the weft thread leading end from its intended travel direction. The open air path portion also facilitates the adjustment of the weft monitoring second section back and forth in the direction of the weft insertion so that an adaptation to different stretching characteristics of the weft thread material is easily accomplished. Furthermore, it has been found that the accelerating energy applied to the weft thread by the feed advance jets in the insertion channel in the reed, is still sufficiently effective in the open air path portion to assure the detection of a broken weft thread end when it travels through the open air path portion. Similarly, a broken weft end is also detected with certainty when the broken weft end travels through the stretching guide channel. Weft threads that are too long are also detected with certainty by the stop motion device of said weft monitoring second section.

BRIEF DESCRIPTION OF THE DRAWINGS

In order that the invention may be clearly understood it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
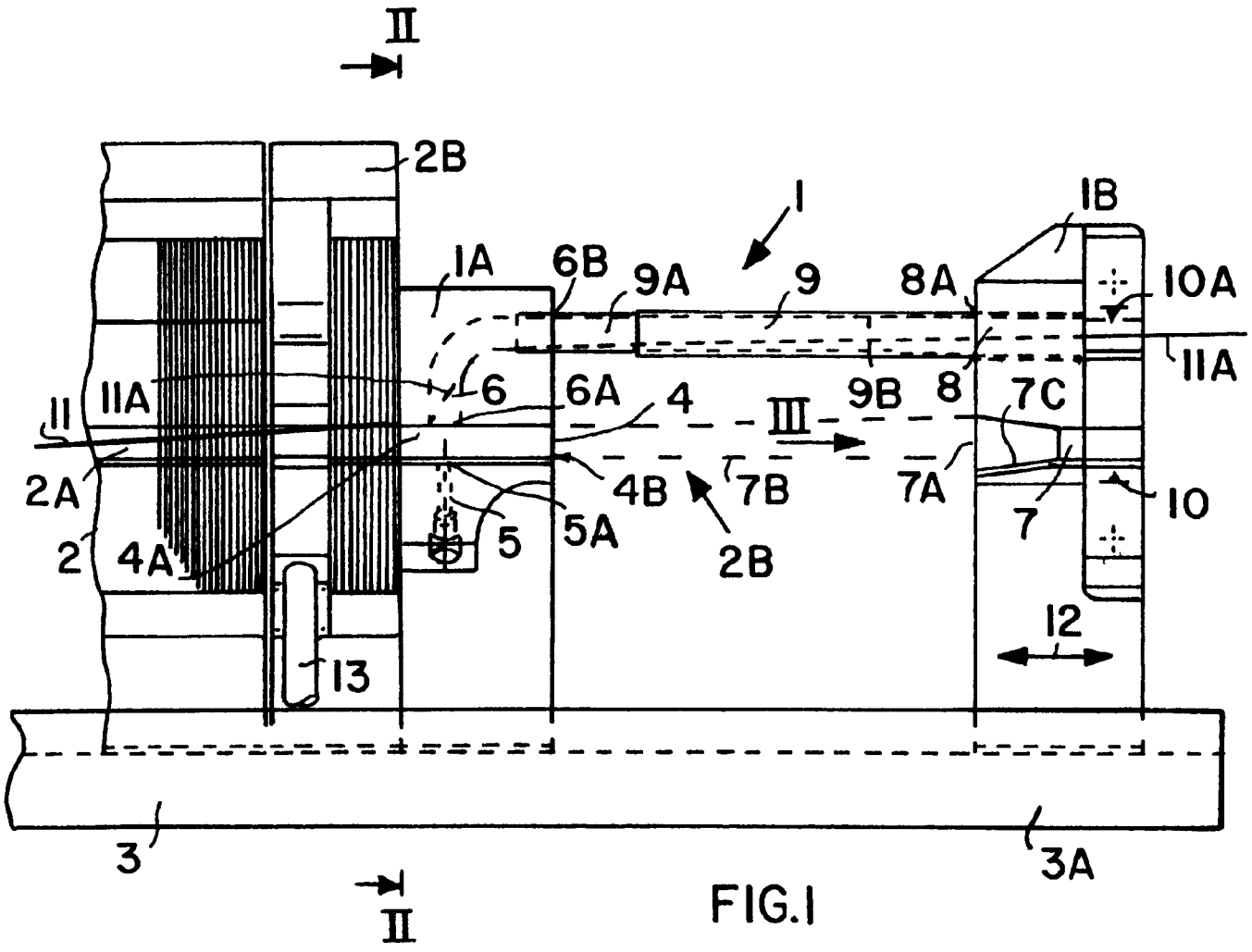
FIG. 1 is a front view of a weft stretching and detecting apparatus according to the invention, including a first section for weft stretching and a second section for weft monitoring.
Figure 2:
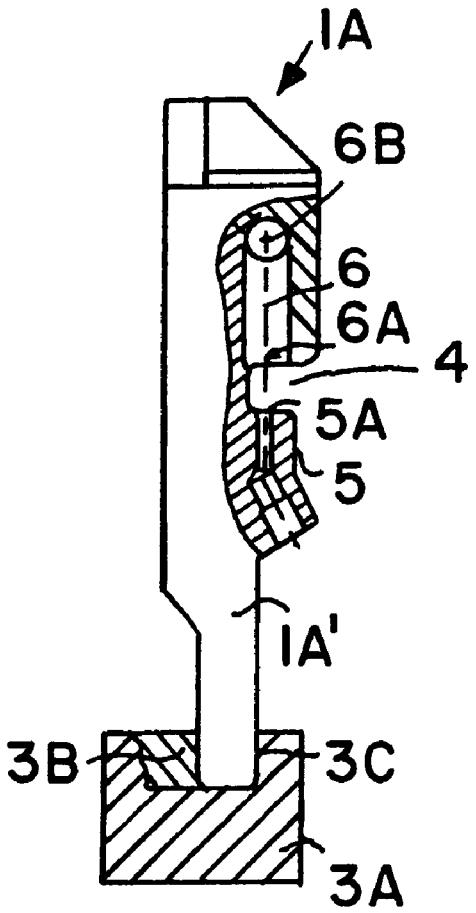
FIG. 2 is a view partly in section along plane II—II in FIG. 1.
Figure 3:
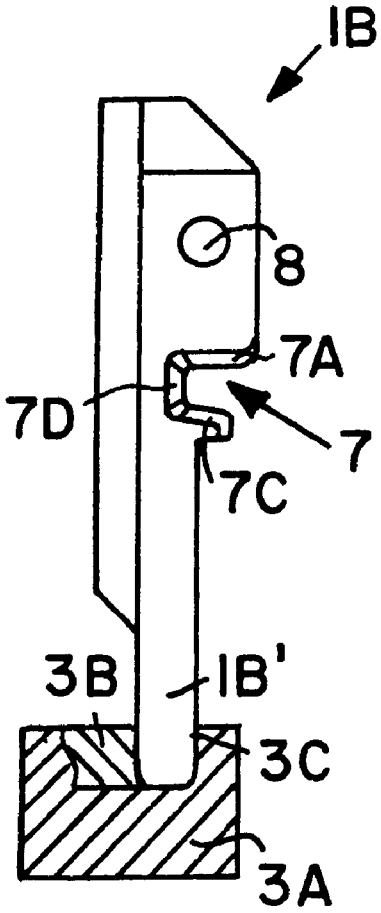
FIG. 3 is a view in the direction of the arrow III in FIG. 1 with a sley extension shown in section as in FIG. 2.

FIGS. 1, 2 and 3 taken in conjunction show the present weft stretching and detecting apparatus as having two separate sections 1A and 1B. The first section 1A forms a weft stretching and guide section and the second section 1B forms a monitoring section. A single weft stop motion device with a transmitter and detector 10, 10A is mounted in the monitoring section 1B for monitoring a stretching channel and a weft guide path. Further details of the single weft stop motion device 10, 10A are disclosed in the above mentioned parent application. At least the monitoring section 1B is mounted for a sliding movement along an extension 3A of a loom sley 3. For this purpose the section 1B has a mounting foot 1B' that reaches into a groove 3C of the sley extension 3A. A wedging member 3B holds the foot 1B' in a fixed position once the section 1B has been properly adjusted in its distance or spacing from the first section 1A as indicated by the double arrow 12.

The section 1A can be mounted to the reed 2 or preferably also to the sley extension 3A directly next to the selvage forming portion 2B of the reed 2. For this purpose the section 1A also has a mounting foot 1A' received in the groove 3C of the extension 3A and held in place by a respective wedging member 3B. If desired section 1A may also be position adjustable.

The reed 2 forms a weft insertion channel 2A for a weft thread 11 having a leading end 11A that can travel either in an extension path 2B that includes three portions 4, 7 and 7B arranged in alignment with each other and in alignment with the weft insertion channel 2A. Path portion 4 is in section 1A, path portion 7 is in section 1B. Path portion 7B extends between sections 1A and 1B as an open air passage. A weft thread stretching and guide channel 1 is formed with a first portion 6 in the stretching section 1A, with a second portion 8 in the monitoring section 1B and with a third portion 9 between these two sections 1A, 1B. Each of the two sections can be manufactured individually and separately and the assembly is greatly facilitated by the mounting feet 1A' and 1B' of the sections 1A and 1B on the sley extension 3A best seen in FIGS. 2 and 3.

The first weft guide path portion 4 is a channel having an entrance end 4A aligned with the weft insertion channel 2A in the reed 2. The second guide path portion 7 is a laterally open channel in the second section 1B. The open air passage of the third guide path portion 7B between the exit 4B of the first portion 4 and the entrance into the second portion 7 is axially aligned with portions 4 and 7 and with the channel 2A. Further, the entrance into the second portion 7 is formed by an upper lead-in ramp 7A, a lower lead-in ramp 7C, and preferably also with a lateral inlet ramp 7D, see FIG. 3. These inlet ramps form a funnel entrance into the second guide pass portion 7 which is flanked by one element 10 of the single weft stop motion device. The other element 10A is positioned to flank an exit of the weft stretching and guide channel 1. The elements 10, 10A are either a receiver and transmitter or vice versa to form the single weft stop motion device that monitors both channels as mentioned above.

The first portion 6 of the weft stretch and guide channel 1 is a curved weft diversion portion 6 with an entrance 6A opening into the channel of the guide portion 4. The second channel portion 8 of the stretching and guide channel 1 forms an exit channel in the second section 1B with an entrance 8A positioned in axial alignment with an exit 6B of the first portion 6. The third channel portion 9 is axially aligned with the exit 6B and the entrance 8A and includes two telescoping tubular members 9A and 9B for guiding the leading end 11A of the weft thread when a stretching is performed by an air jet introduced into the curved diversion portion 6 through an inlet 5 connected to an air pressure source not shown. An exit 5A of the inlet 5 is arranged in alignment opposite the entrance 6A of the diverting portion 6. A proper weft thread 11 correctly inserted is diverted into the entrance 6A for stretching in the channel portions 6, 8 and 9 by the air jet. An incorrect or faulty weft thread is not diverted, but rather passed through the path 4, 7B and 7 for detection at the exit end by the weft stop motion device 10, 10A.

Whether or not a weft thread is correctly inserted is determined by a conventional weft stop motion device 13 positioned upstream of the entrance 4A into the channel portion 4 as viewed in the weft insertion direction. The device 13 controls the application of an air jet through the inlet 5. An incorrectly inserted or faulty weft thread does not cause an air jet and therefore travels through the path 4, 7B and 7. A correctly inserted and proper weft thread causes an air jet blow for diversion of the leading end 11A into the channel portions 6, 9 and 8 for stretching. Where no stretching is intended only the path 4, 7B, 7 will be used. In both instances the single weft stop motion device 10 is effective to monitor both the path and the channel.

As mentioned above, the guide portion 7B is an open air passage for the weft thread leading end 11A. It has been found that such an open air passage greatly facilitates and simplifies the construction of the present device without any problems in passing the leading end 11A of a faulty or improperly inserted weft thread from the portion 4 to the portion 7 where the funnel-shaped entrance 7A, 7C, 7D into the portion 7 facilitates the travel of the leading weft end 11A into the portion 7 for detection by the weft stop motion device 10, 10A.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A weft stretching and detecting apparatus for a jet weaving loom with a sley (3) and a reed (2) forming a weft insertion channel (2A), said apparatus comprising a sley extension (3A), a weft stretching first section (1A) adapted to be mounted to said weaving loom next to said reed, a weft monitoring second section (1B) mounted for sliding movement on said sley extension (3A) and spaced from said weft stretching first section (1A) in a weft insertion direction, defined by said weft insertion channel (2A), a weft guide path (4, 7, 7B) in axial alignment with said weft insertion direction, a weft stretching and guide channel extending laterally displaced from said weft guide path, and a single weft stop motion device (10) positioned in said weft monitoring second section for monitoring a weft thread passing through said weft guide path or through said weft stretching and guide channel, wherein said single weft stop motion device (10) is position adjustable with a position adjustment of said weft monitoring second section (1B).

2. The apparatus of claim 1, wherein said weft guide path comprises a first path portion (4) in said weft stretching first section (1A), a second path portion (7) in said weft monitoring second section (1B), and a third path portion (7B) between said first and second path portions (4, 7), said first, second, and third path portions (4, 7, 7B) extending in axial alignment with each other and with said weft insertion direction, wherein said weft stretching and guide channel comprises a weft diversion first channel portion (6), a second channel portion (8) in said weft monitoring section (1B), and a third channel portion (9) between said first and second channel portions (6, 8), said third channel portion extending in axial alignment at least with part of said first channel portion (6) and with said second channel portion (8), said third channel portion comprising telescoping channel elements (9A, 9B) for permitting said sliding movement of said weft monitoring second section (1B) toward and away from said weft stretching first section (1A), wherein a length of said third path portion (7B) and of said third channel portion (9) between said first and second sections (1A, 1B) is adjustable by a sliding movement of said weft monitoring section (1B) along said sley extension (3A).

3. The apparatus of claim 2, wherein said third path portion (7B) of said weft guide path is an open air path portion leading into said second path portion (7) in said weft monitoring section (1B), whereby the weft thread is not positively guided in said open air path portion.

4. The apparatus of claim 1, wherein said weft monitoring second section (1B) has a weft guide path portion (7B) including an upper weft lead-in ramp (7A) and a lower weft lead-in ramp (7C) for receiving a leading end (11A) of a weft thread (11) passing through said weft guide path into said weft guide path portion (7B).

5. The apparatus of claim 1, wherein said weft stretching first section (1A) is also mounted to said sley extension (3A) next to said reed and spaced from said weft monitoring second section (1B) in said weft insertion direction.

6. The apparatus of claim 1, wherein said sley extension (3A) comprises a guide groove (3C), said weft monitoring second section (1B) having a guide foot (1B') slidable in said guide groove (3C), and a wedging member (3B) in said guide groove (3C) locking said guide foot (1B') in an adjusted position along said guide groove.

7. The apparatus of claim 6, wherein said weft stretching first section (1A) comprises a mounting portion (1A') received in said guide groove (3C) and held in place by said wedging member (3B) in said guide groove (3C).

* * * * *